US012560113B2

(12) United States Patent
Hasinoff

(10) Patent No.: US 12,560,113 B2
(45) Date of Patent: Feb. 24, 2026

(54) OIL PAN DRAIN PLUG WITH LOCKING FEATURE

(71) Applicant: Kristopher J. Hasinoff, Winnipeg (CA)

(72) Inventor: Lorne E. Hasinoff, Winnipeg (CA)

(73) Assignee: Kristopher J. Hasinoff, Winnipeg (CA)

( * ) Notice: Subject to any disclaimer, the term of this patent is extended or adjusted under 35 U.S.C. 154(b) by 0 days.

(21) Appl. No.: 18/596,033

(22) Filed: Mar. 5, 2024

(65) Prior Publication Data

US 2024/0309782 A1 Sep. 19, 2024

Related U.S. Application Data

(60) Provisional application No. 63/489,860, filed on Mar. 13, 2023.

(51) Int. Cl.
*F01M 11/04* (2006.01)
*F01M 11/00* (2006.01)

(52) U.S. Cl.
CPC ..... *F01M 11/0408* (2013.01); *F01M 11/0004* (2013.01); *F01M 2011/0416* (2013.01); *F01M 2011/0425* (2013.01)

(58) Field of Classification Search
CPC ..... F01M 11/0004; F01M 11/0408; F01M 11/0458; F01M 2011/0416; F01M 2011/0425
See application file for complete search history.

(56) References Cited

U.S. PATENT DOCUMENTS 6,234,274 B1 * 5/2001 van der Griendt ..... F01M 11/0408 285/94
10,094,514 B1 * 10/2018 Sammataro ..... F01M 11/0408

FOREIGN PATENT DOCUMENTS

DE 102012008521 A1 * 11/2013 ..... F01M 11/04
EP 3208435 A1 * 8/2017
WO WO-2010017867 A1 * 2/2010 ..... F01M 11/0408

* cited by examiner

*Primary Examiner* — Minh Truong
(74) *Attorney, Agent, or Firm* — Ryan W. Dupuis; Michael R. Williams; Ade & Company Inc.

(57) ABSTRACT

A drain plug for an engine collection pan has an external screw portion forming a threaded connection with the collection pan and a catch formed on the plug body. A lock ring axially slides on the plug body between a released position in which the lock ring does not interfere with rotation of the plug body relative to the collection pan to release the threaded connection and a locked position connected between the catch on the plug body and an external stop on the collection pan to prevent release of the threaded connection. A retainer on the plug body selectively retains the lock ring in the locked position. The lock ring is a robust structure, resistant to breakage even in colder climates. The axial sliding does not require any tool for application of torque to release the lock ring.

19 Claims, 4 Drawing Sheets

OIL PAN DRAIN PLUG WITH LOCKING FEATURE

This application claims the benefit under 35 U.S.C. 119(e) of U.S. provisional application Ser. No. 63/489,860, filed Mar. 13, 2023.

FIELD OF THE INVENTION

The present invention relates to a drain plug for an oil pan that collects oil in an internal combustion engine, and more particularly the present invention relates to a drain plug that forms a threaded connection with the oil pan and that includes a locking feature that prevents the threaded connection of the drain plug with the oil pan being released.

BACKGROUND

A common structure of an internal combustion engine is to provide a sump area at the bottom of the engine block where lubricating fluids such as oil are collected for subsequent recirculation through the engine by an oil pump. The sump area is enclosed by an oil drain pan. Proper maintenance of a typical engine requires that the oil be changed at periodic intervals. Changing the oil requires removal of the oil in the sump area through a drain hole in the drain pan. The drain hole is commonly provided with a screw component formed internally for forming a threaded connection with a drain plug received in the drain hole. To prevent the drain plug from being unthreaded inadvertently during normal operation of the vehicle which would allow lubrication fluids to drain from the engine and potentially cause costly damage to the engine, various attempts have been proposed for preventing the drain plug from being unscrewed from the drain hole.

Known prior art attempts generally rely on a resilient stop mounted on one of the drain pan or the drain plug that must be flexed around corresponding stops on the other one of the drain pan or the drain plug. Various examples of resilient stops for a drain plug are described in U.S. Pat. No. 8,875,933 by BM Global Technology Operations LLC; U.S. Pat. No. 11,015,495 by Hyundai Motor Company and Kia Motors Corporation; and U.S. Pat. No. 11,454,146 by Mahle International GMBH and Mahle Filter Systems Japan Corporation. The resilient stops described in the prior art can become brittle, particularly in colder climates, such that they can readily break and no longer provide resistance to the drain plug being unscrewed. Releasing the stops also commonly requires application of torque with a tool to overcome the holding force of the stop, but it is possible to apply too much torque with the tool which further contributes to breakage of the stops.

SUMMARY OF THE INVENTION

According to one aspect of the invention there is provided a drain plug for cooperation with a drain hole in boundary wall of a collection pan on an engine in which the drain hole includes an internal screw portion and an external stop mounted externally on the boundary wall, the drain plug comprising:

- a plug body arranged to occupy the drain hole;
- an external screw portion supported on the plug body in which the external screw portion is arranged to form a threaded connection with the internal screw portion on the collection pan when the plug body is inserted into the drain hole in a mounted position of the plug body;

- a catch formed on the plug body;
- a lock ring supported on the plug body such that the lock ring is slidable in an axial direction of the plug body between (i) a released position of the lock ring in which the lock ring does not interfere with rotation of the plug body relative to the collection pan to release said threaded connection and (ii) a locked position in which the lock ring is operatively connected between the catch on the plug body and the external stop on the collection pan so as to prevent relative rotation between the plug body and the collection pan and thereby prevent release of said threaded connection; and
- a retainer supported on the plug body so as to be arranged to selectively retain the lock ring in the locked position.

The use of a lock ring that is movable between locked and released positions provides a robust structure that is resistant to breakage even in colder climates. The axial sliding movement to engage and disengage the lock ring does not require any torque to be applied to release the lock ring which minimizes the opportunity for lock ring to be broken by application of excessive force from a tool.

According to a second aspect of the present invention there is provided a fluid collection pan assembly for an engine, the fluid collection pan assembly comprising:

- a collection pan including a boundary wall, a drain hole formed in the boundary wall, an internal screw portion within the drain hole, and at least one external stop mounted externally on the boundary wall;
- a plug body arranged to occupy the drain hole;
- an external screw portion supported on the plug body in which the external screw portion is arranged to form a threaded connection with the internal screw portion on the collection pan when the plug body is inserted into the drain hole in a mounted position of the plug body;
- at least one catch formed on the plug body;
- a lock ring supported on the plug body such that the lock ring is slidable in an axial direction of the plug body between (i) a released position of the lock ring in which the lock ring does not interfere with rotation of the plug body relative to the collection pan for releasing said threaded connection and (ii) a locked position in which the lock ring is operatively connected between said at least one catch on the plug body and the at least one external stop on the collection pan so as to prevent relative rotation between the plug body and the collection pan and thereby prevent release of said threaded connection; and
- a retainer releasably mounted on the plug body so as to be arranged to selectively retain the lock ring in the locked position.

Preferably the at least one catch on the plug body comprises a lug protruding radially from the plug body.

Preferably the at least one external stop comprises two external stops at diametrically opposing sides of the drain hole and the at least one catch comprises two catches at diametrically opposing sides of the plug body.

The plug body may be arranged to be received in the drain hole in the mounted position such that the at least one catch engages the at least one external stop.

The plug body may be arranged to be received in the drain hole in the mounted position such that the at least one catch on the plug body and the at least one external stop on the collection pan lie in a common plane perpendicular to the axial direction.

The lock ring preferably comprises at least one slot extending in a circumferential direction between two opposing end surfaces of the slot, in which the at least one slot is arranged to receive the at least one external stop of the collection pan and the at least one catch on the plug body therein between the end surfaces of the slot in the locked position of the lock ring so as to prevent separation of the at least one external stop and the at least one catch from one another in the circumferential direction.

When the plug body is arranged to be received in the drain hole in the mounted position such that at least one gap is defined to extend in a circumferential direction between the at least one catch on the plug body and the at least one external stop on the collection pan, the lock ring is preferably arranged to fully occupy said at least one gap in the locked position. More particularly, the lock ring may comprise a main body portion which is annular in shape to extend fully about a circumference of the plug body and at least one protruding portion extending axially from the main body portion in which said at least one protruding portion is arranged to fully occupy said at least one gap in the locked position.

The plug body may comprise a recessed groove formed in an outer surface of the plug body, in which the retainer is releasably mounted in the recessed groove to retain the lock ring in the locked position. More particularly, the outer surface of the plug body locating the recessed groove therein is preferably cylindrical in shape the recessed groove is preferably annular in shape, and the retainer preferably comprises a resilient split ring arranged to be partly received within recessed groove.

The plug body may further comprise (i) a drain passage communicating through the plug body from an inner opening for communication with an interior of the collection pan to an outer opening for communication with an exterior of the collection pan, (ii) a valve seat defined within the drain passage between the inner opening and the outer opening, (iii) a valve member supported within the plug body for displacement relative to the valve seat between open and closed positions of the valve member, and (iv) a cover member arranged to be releasably secured to an external portion of the plug body so as to enclose the outer opening in a mounted position of the cap member on the plug body.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
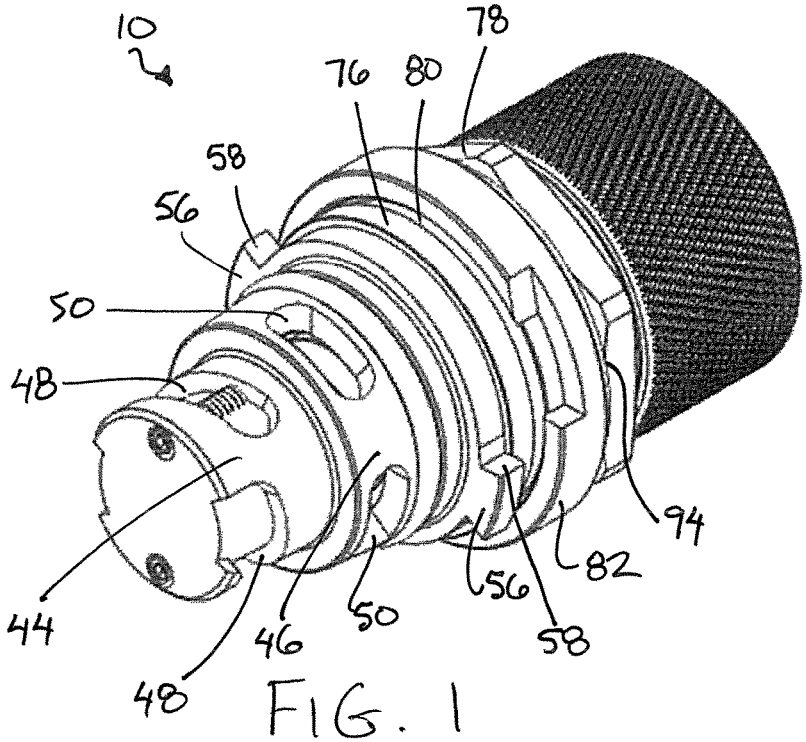
FIG. 1 is a perspective view of the drain plug according to the present invention for mounting in the drain hole of an engine oil pan.

Referring to the accompanying figures there is illustrated an oil pan drain plug generally indicated by reference numeral 10. The oil pan drain plug 10 is arranged for cooperation with a fluid collection pan assembly of an internal combustion engine in which the fluid collection pan assembly includes a fluid collection pan or oil drain pan 12 supported at a bottom side of the engine for collecting lubricating fluids of the engine.

According to the illustrated embodiment, the drain pan 12 comprises a bottom boundary wall 14 locating a drain hole 16 formed within the boundary wall in which the drain hole is typically used to drain fluids such as lubricating oil from the drain pan, for example when servicing the engine to change the oil of the engine. The drain plug 10 shown in the figures comprises an internal valve assembly operable between an open position and closed positions for draining oil through the drain plug when the valve assembly is opened and for sealing the drain hole closed when the valve assembly is closed.

As further shown in the illustrated embodiment, the drain pan 12 in this instance further includes an inner socket body 18 integrally formed as a unitary structure together with the boundary wall 14 within the interior of the drain pan. The socket body 18 comprises a generally cylindrical wall 20 supported coaxially with the drain hole while extending axially inward from the boundary wall. An inner end of the cylindrical wall 20 is enclosed by an end wall 22 at the inner end. The cylindrical wall is stepped in profile so as to have (i) a first inner diameter at a first portion of the wall nearest to the end wall 22 and (ii) a second inner diameter which is greater than the first inner diameter at a second portion of the wall spanning axially between the first portion and the boundary wall of the pan. A plurality of drain ports 24 communicate radially through the second portion of the boundary wall at circumferentially spaced positions so that fluids within the drain pan can drain through the drain ports 24 into the interior of the socket body 18 which is an open communication to the exterior of the drain pan through the drain hole 16.

The inner socket body 18 is further provided with an internal screw portion in the form of two lugs 26 mounted on the inner surface of the cylindrical wall to protrude radially inwardly from the inner surface of the cylindrical wall. The two lugs 26 are supported diametrically opposite from one another and serve to form a threaded connection with the drain plug 10 when the drain plug is received within the drain hole 16 in a mounted position.

The boundary wall 14 of the drain pan 12 is provided with an external support ring 28 mounted coaxially about the drain hole 16 so as to protrude axially outward from the exterior of the boundary wall. The support ring 28 is annular in shape and has an inner diameter which is greater than the diameter of the drain hole 16 to define a radial gap between the drain hole 16 and the inner boundary of the support ring 28.

Two external stops 30 are mounted on the exterior of the boundary wall 14 of the drain pan to protrude radially inwardly from the inner boundary of the support ring 28 at respective diametrically opposed locations relative to the drain hole 16. The external stops 30 are formed integrally as a unitary structure together with the boundary wall of the drain pan and the support ring 28. The external stops extend radially inwardly partway across the radial gap defined between the drain hole 16 and the inner boundary of the support ring 28. Each external stop 30 includes circumferentially opposed end faces including a ramped face 32 and a flat end face 34. The ramped face 32 extends radially inward at a slope in the circumferential direction towards the opposing flat end face 34 such that the ramped end face 32 and the flat end face 34 meet one another at an inner apex of the stop 30. The flat end face 34 is perpendicular to the circumferential direction so as to be oriented to form a catch that is engaged by the drain plug in the mounted position to prevent over-rotation of the threaded connection of the drain plug 10 into the internal screw portion of the drain hole as the drain plug is mounted into the drain hole. Both flat end faces 34 of the two external stops 30 function to prevent rotation of the drain plug in the same direction.

The drain plug 10 generally includes a plug body formed in two parts at the time of manufacturing such that the two parts are fixed and immovable relative to one another once joined. The two parts of the plug body include a crown portion 40 which is primarily received internally within the inner socket body 18 in the mounted position and a valve portion 42 which primarily protrudes externally of the drain pan 12 in the mounted position.

The crown portion 40 of the plug body is generally cylindrical in shape and includes (i) a first portion 44 at the innermost end of the plug body having a first outer diameter arranged to be received within the inner diameter of the corresponding first portion of the cylindrical wall 20 of the inner socket body 18, and (ii) a second portion 46 having an outer diameter which is greater than the first portion while being suitably sized to be received within the corresponding second portion of the cylindrical wall 20 of the inner socket body 18. The first portion 44 of the crown portion of the plug body locates an external screw portion formed thereon in the form of two helical slots 48 formed in the exterior surface of the plug body. Each helical slot 48 follows a helical path to extend partway about the circumference of the plug body. Each helical slot 48 is open in the axial direction at the innermost end of the plug body. The helical slots 48 are diametrically opposed from one another and serve to form a threaded connection with the lugs 26 of the inner socket body 18 of the drain pan as the drain plug is mounted on and removed from the drain pan. As the drain plug is inserted into the drain hole, the two lugs 26 are inserted axially through the open ends of the helical slots 48 respectively at the innermost end of the drain plug. Continued insertion of the drain plug into the drain hole causes the lugs 26 to follow the helical slots 48 to form the threaded connection between the drain plug and the drain pan as the drain plug is screwed into the drain hole.

Once in the mounted position a set of drain ports 50 within the second portion 46 of the plug body align with corresponding drain ports 24 of the inner socket body of the drain pan. The drain ports 50 in the plug body extend radially through the boundary wall of the crown portion of the plug body to define inner openings of the plug body which communicate with an internal drain passage 52 extending axially within the interior of the plug body. The crown portion 40 of the plug body also locates an annular groove in the exterior cylindrical surface of the crown portion which locates an O-ring gasket 54 therein for forming a seal between the exterior surface of the plug body and the inner surface of the inner socket body 18 of the drain hole 16 in the mounted position of the drain plug.

The crown portion 40 of the plug body further includes two radially protruding lugs 56 at the outermost end of the crown portion such that the lugs 56 are situated directly against the exterior side of the boundary wall 14 of the drain pan in the mounted position. The lugs 56 protrude radially outward from the crown portion such that the outer diameter defined by the lugs 56 is greater than the diameter of the drain hole 16 while being approximately equal to or slightly less than the inner diameter of the support ring 28 so that the lugs 56 are received within the radial gap between the drain hole 16 and the inner boundary of the support ring 28 similarly to the external stops 38 on the drain pan which are also received in the same radial gap.

The lugs are diametrically opposite with one another and each include circumferentially opposed end faces 58 which lie generally perpendicular to the circumferential direction. The lugs 56 are supported on the crown portion such that the lugs align with and abut respective ones of the flat end faces 34 of the external stop 30 when the drain plug reaches a fully mounted position within the drain hole as the drain plug is screwed into the drain hole. The end face 58 on each catch that abuts the flat end face 34 of the corresponding external stop in the mounted position thus defines a catch on the plug body which prevents over-rotation of the threaded connection between the drain plug 10 and the drain pan 12 when mounting the drain plug into the drain hole.

In the mounted position of the drain plug within the drain hole, with the lugs 56 abutted with the external stops 30 respectively, there remains two circumferentially extending gaps 60 between the cylindrical outer surface of the crown portion 40 and the inner cylindrical boundary of the support ring 28. Each circumferential gap 60 extends in the circumferential direction between a ramped face 32 of one of the external stops 30 and one of the end faces 58 of the lugs 56 that engages the other external stop 30. The circumferential gaps 60 are diametrically opposed from one another.

The valve portion 42 of the plug body includes a neck of reduced outer diameter at the innermost end of the valve portion which is externally threaded for forming a threaded connection with corresponding internal threads at the outermost end of the crown portion 40 of the plug body. A suitable O ring gasket 62 is mounted between corresponding surfaces of the valve portion 42 and the crown portion 40 respectively to form a sealed connection therebetween. The valve portion 42 may be joined to the crown portion 40 so as to be fixed and immovable therebetween using various techniques including bonding of the threaded connection, or additional mounting of a structure such as a transverse pin or setscrew and the like that is coupled between the two portions of the plug body for example.

The drain passage 52 within the plug body extends axially from an inner end in communication with the drain ports 50 forming inner openings in communication with the interior of the drain pan, to an outer end at the outermost end of the plug body. An outer opening 64 of the drain passage is located at the exterior end of the plug body to communicate axially through the outermost end of the plug body.

A cover member 66 is provided in the form of a cap having an internally threaded cylindrical wall enclosed at the outermost end by an end wall such that the cover member 66 cooperates with external threading at the outermost end of the valve portion 42 of the plug body. In this manner the cover member 66 can be threaded or screwed onto the exterior end of the plug body to fully close the drain passage at the outer end thereof. Unscrewing the cover member 66 provides access to the drain passage to permit draining of fluids through the plug body when the valve assembly is opened. Suitable O ring gaskets 68 are mounted between the cover member 66 and the exterior of the valve portion 42 of the plug body to form a sealed connection therebetween.

The valve assembly includes a valve seat 70 defined within the interior of the drain passage at the innermost end of the valve portion 42 of the plug body. A valve member 72 of the valve assembly includes a head supporting an O ring gasket therein to form a sealed connection with the surrounding valve seat 70 in a closed position of the valve and a shaft extending axially from the head of the valve member 72 towards the exterior of the drain plug.

A drain ring 74 is mounted at the exterior end of the shaft of the valve member 72 opposite the head of the valve member. The drain ring 74 has an outer diameter that closely fits within the inner diameter of the cylindrical inner surface of the drain passage 52 extending through the valve portion 42 of the plug body. The drain ring and the valve member 72 are connected so as to be movable together axially from the closed position to an open position of the valve member, guided by the drain ring sliding along the drain passage. The drain ring includes a plurality of circumferentially spaced drain ports extending axially through the drain ring such that the drain ring does not provide any obstruction to fluid flow through the drain passage 52 in the axial direction.

A spring 75 is mounted under compression between the drain ring and an internal shoulder formed within the inner surface of the drain passage 52 in proximity to the valve head such that the spring is compressed as the valve member is displaced from the closed position towards the open position. In this manner the spring 75 biases the valve assembly to the closed position.

The valve portion 42 of the plug body of the drain plug further includes a radial flange 78 protruding from the remainder of the outer surface of the plug body at an intermediate location adjacent the inner end of the external threading that mounts the cover member 66 thereon. The radial flange 78 has an outer perimeter edge having a hexagonal shape in cross section to form a gripping surface for a wrench type tool.

Figure 2:
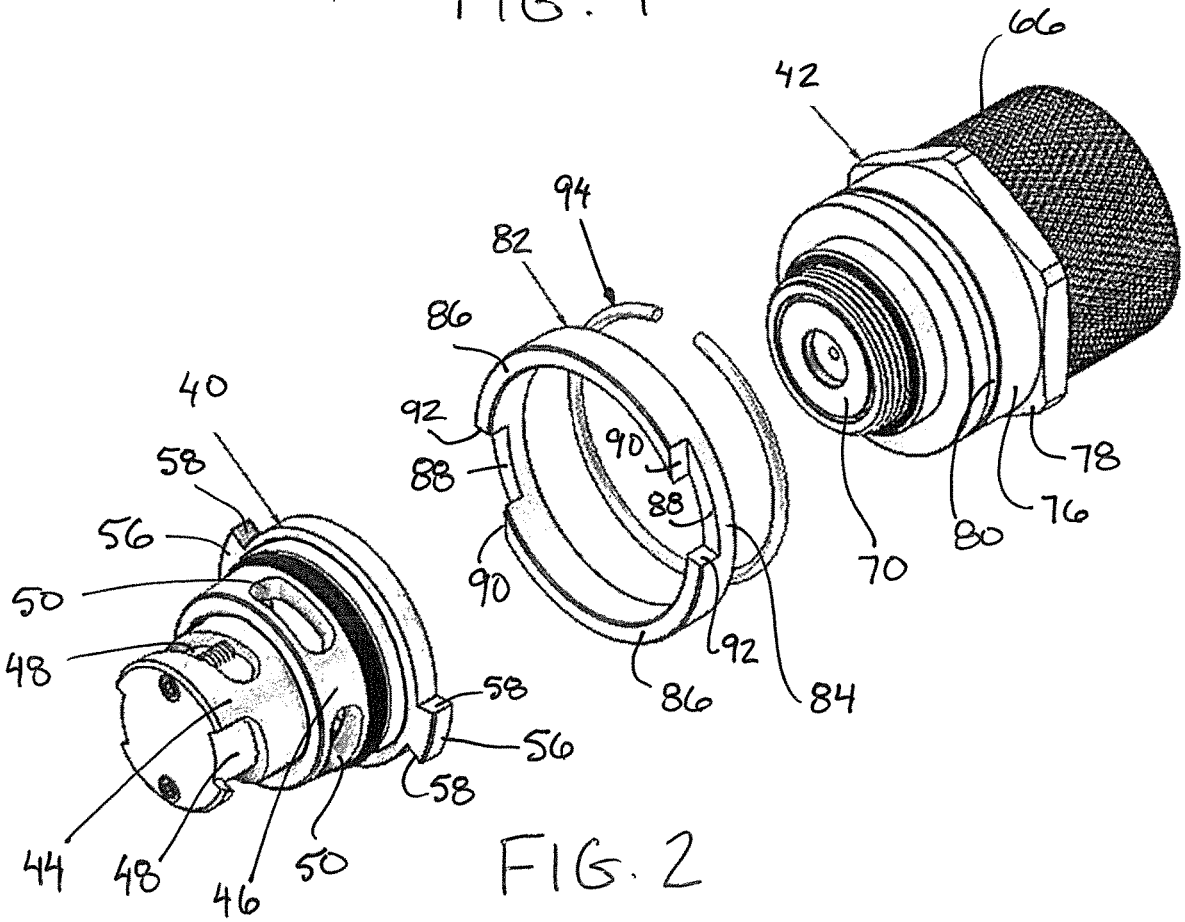
FIG. 2 is an exploded view of the drain plug according to FIG. 1.
Figure 3:
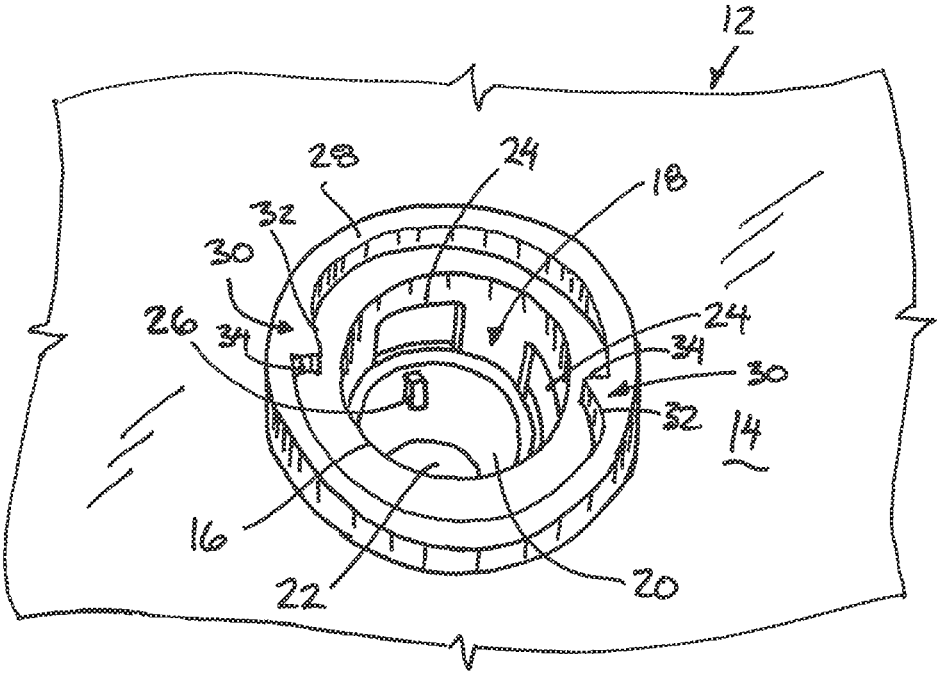
FIG. 3 is a perspective view of an external portion of the oil pan for receiving the drain plug according to FIG. 1.
Figure 4:
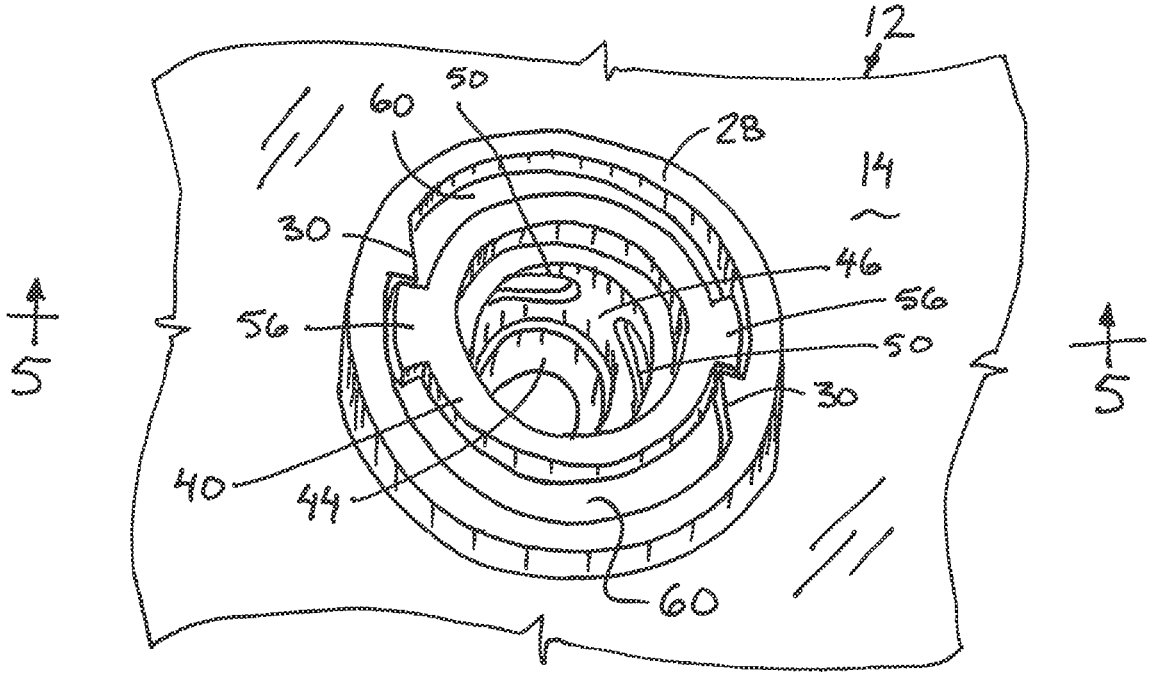
FIG. 4 is another perspective view of the external portion of the oil pan illustrating the crown portion of the plug body of the drain plug according to FIG. 1 mounted on the oil pan.
Figure 5:
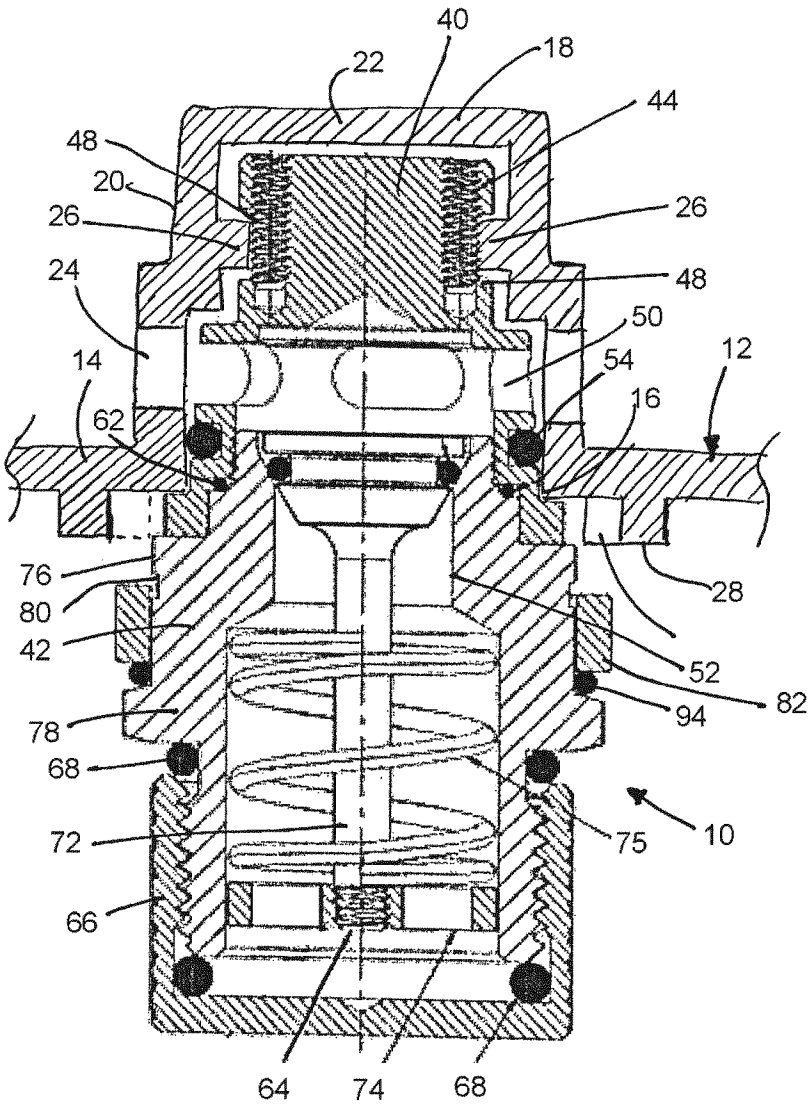
FIG. 5 is a sectional view of the drain plug installed on the oil pan along the line 5-5 in FIG. 4 in which the lock ring is in a released position relative to the oil pan.
Figure 6:
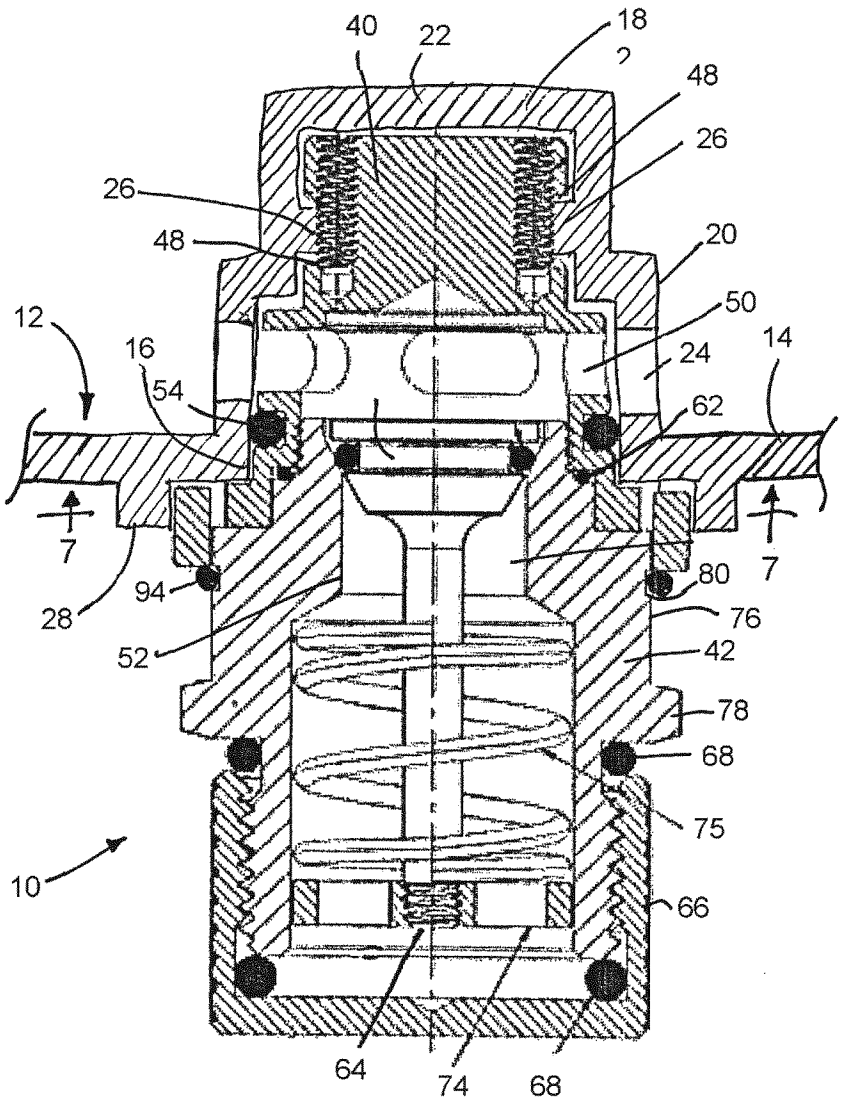
FIG. 6 is a sectional view of the drain plug installed on the oil pan along the line 5-5 in FIG. 4 in which the lock ring is in a locked position relative to the oil pan.
Figure 7:
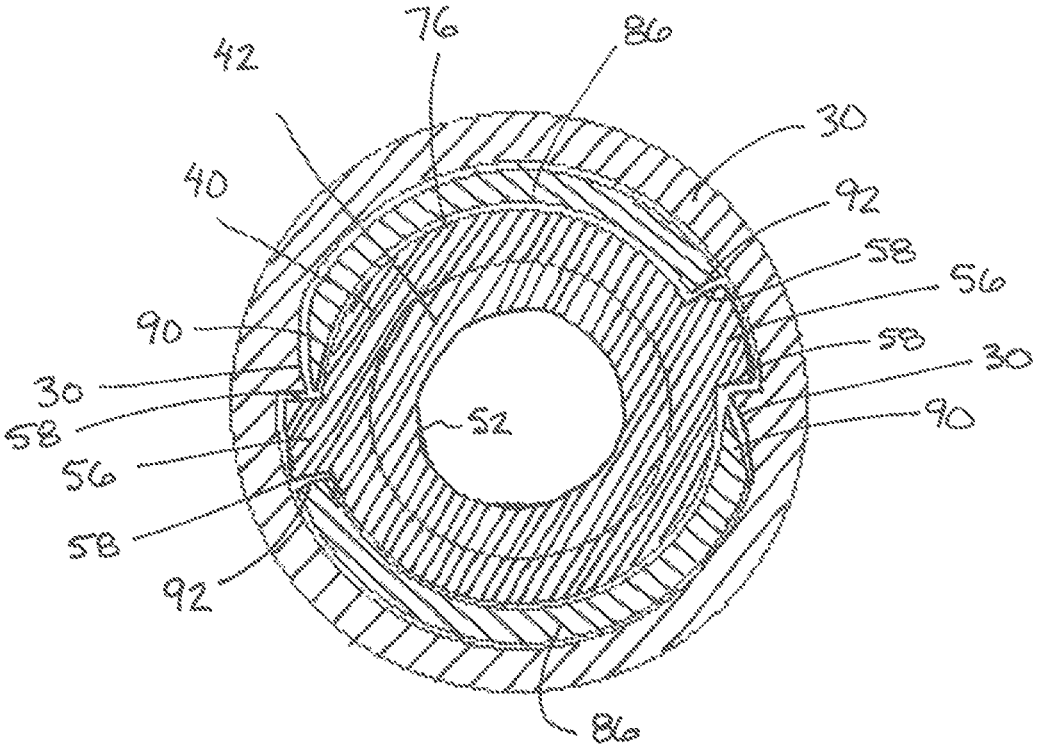
FIG. 7 is a sectional view of the drain plug in the locked position along the line 7-7 in FIG. 6.

The valve portion 42 of the plug body further includes an intermediate outer surface 76 which is generally cylindrical in shape to extend circumferentially about the plug body and axially between the neck of the valve portion 42 that forms the threaded connection with the crown portion 40 and the radial flange 78 so that the intermediate outer surface 76 is located between an external screw portion of the plug body and the outer end of the plug body as shown in FIGS. 2 and 5. An annular groove 80 is formed in the intermediate outer surface 76 at a location spaced axially from the radial flange 78 towards the crown portion of the plug body.

A lock ring 82 is supported about the valve portion 42 of the plug body so as to be axially slidable along the intermediate outer surface 76 between a released position of the lock ring in which the lock ring does not interfere with the rotation of the plug body relative to the collection pan for releasing the threaded connection between the drain plug and the drain hole, and a locked position in which the lock ring is operatively connected between the catches on the lugs 56 of the plug body and the external stops 30 on the collection pan so as to prevent relative rotation between the plug body and the collection pan and thereby prevent release of the threaded connection of the drain plug within the drain hole.

The lock ring 82 includes a main body portion 84 which is annular in shape having an inner diameter which closely matches the outer diameter of the intermediate outer surface 76 of the plug body to support the lock ring for axial sliding movement. The lock ring 82 further includes two protruding portions 86 which protrude axially in a common direction from the main body portion 84 towards the inner end of the plug body at diametrically opposing locations on the main body portion. Each protruding portion 86 extends partway about the circumference of the lock ring between two opposing end faces of the protruding portion.

Each protruding portion 86 is sized and shaped to fully occupy a respective one of the circumferential gaps 60 formed between the lugs 56 and the external stops 30 locked position of the lock ring, while having a thickness in the radial direction that spans the radial gap between the outer diameter of the plug body and the inner diameter of the support ring 28. More particularly, each protruding portion includes a sloped end face 90 which matches the shape and slope of a corresponding ramped face 32 of the external stop with which it is abutted and one radial end face 92 at the circumferentially opposed end of the protruding portion 86 which is perpendicular to the circumferential direction for abutment against the corresponding square end face 58 of one of the lugs 58. Each protruding portion thus prevents a respective one of the lugs 56 from being displaced in the circumferential direction towards the opposing external stops 30 to thereby prevent relative rotation between the drain plug in the drain hole so as to prevent releasing of the threaded connection between the drain plug and the drain hole.

The protruding portions 86 are spaced apart from one another at diametrically opposing sides of the lock ring so as to define two corresponding slots 88 at diametrically opposing locations on the lock ring. Each slot 88 extends partway about the circumference of the lock ring between the corresponding end faces of the protruding portions 86. Each slot 88 is arranged to receive one of the lugs 56 and an abutted one of the external stops 30 therein such that the opposing end faces of the slot 88 are closely located adjacent corresponding end faces of the abutted pairing of one lug 56 and one external stop 30 in the locked position of the lock ring with the drain plug in a mounted position within the drain hole. Each slot thus prevents separation of a respective one of the lugs 56 from the abutted external stop 30 in the circumferential direction to thereby assist in preventing relative rotation between the drain plug and the drain hole so as to further prevent releasing of the threaded connection between the drain plug and the drain hole.

A retainer 94 is also supported externally about the intermediate outer surface 76 of the valve portion 42 of the drain plug so as to be releasably mounted relative to the annular groove 80 in the plug body for selectively retaining the lock ring in the locked position. More particularly, the retainer 94 comprises a split ring having an overall shape which is generally C-shaped, formed of a wire or rod having a diameter which fits within the axial dimension of the annular groove 80. The inner diameter of the overall split ring defining the retainer 94 in a relaxed or unflexed state is approximately equal to the outer diameter at the innermost recessed surface of the annular groove 80 so as to be less than the outer diameter of the cylindrical outer surface 76 of the plug body. The retainer is sufficiently resilient that the inner diameter of the retainer can be resiliently expanded by expanding the circumferential gap in the split ring such that the inner diameter corresponds to the larger outer diameter of the intermediate outer surface 76 of the plug body while remaining biased to return to the relaxed and unflexed state. In the expanded position of the retainer 94, the retainer can be slidably displaced along the intermediate outer surface 76 of the plug body similarly to the lock ring.

More particularly, the retainer 94 is axially slidable between a disengaged position spaced axially outward from the retainer groove such that the lock ring is freely slidable between locked and released position thereof, and an engaged position in which the retainer 94 is aligned with the retainer groove such that the resilient material of the retainer 94 causes the interior diameter of the retainer to be reduced to partially receive the retainer 94 within the annular groove 80 in the radial direction. The thickness of the retainer in the radial direction is such that a portion of the split ring remains protruding radially outward relative to the surrounding intermediate outer surface 76 of the plug body in the engaged position of the retainer such that the retainer abuts the outer end of the lock ring and prevents the lock ring from being axially displaced beyond the retainer within the annular groove 80. The annular groove is situated directly adjacent the exterior end of the lock ring when the lock ring is in the locked position such that the retainer 94 in the engaged position effectively retains the lock ring in the locked position.

The drain plug 10 is mounted on the drain pan 12 by initially positioning the retainer 94 in the disengaged position and the lock ring in the released position spaced axially outward from the lugs 56 on the crown portion of the plug body. The external screw portion formed by the helical slots 48 on the plug body can thus cooperate with the lugs 26 forming the internal screw portion within the drain hole such that the drain plug is screwed into the drain hole until the drain plug reaches the mounted position with the lugs 56 abutted against the exterior surface of the drain pan and abutted with the external stops 30 respectively.

To prevent the drain plug from being released from the drain hole once in the mounted position, the lock ring is axially displaced along the plug body until the protruding portions 86 of the lock ring are received within and fully occupy the circumferential gaps 60 between the lugs 56 and the external stops 30 respectively. In this manner the lock ring prevents relative rotation between the drain plug and the drain pan to prevent release of the threaded connection between the drain plug and the drain hole. Once the lock ring is in the locked position, the retainer 94 can be similarly displaced axially along the outer surface of the plug body until the retainer is aligned with the annular groove 80 which partly receives the retainer therein in the engaged position of the retainer to prevent release of the lock ring from the locked position.

Once the lock ring has been locked by the retainer in the engaged position, the drain plug can be used in the normal manner. That is when an oil change is desired, an operator unscrews the cover member 66 and a suitable drainage tool can be threaded onto the plug body in place of the cover member 66. The drainage tool cooperates with the valve member 72 to open the valve member as the drainage tool is mounted onto the external threads of the plug body so that fluid can be drained from the oil pan through the drain ports in the internal socket body and the drain ports in the plug body, and subsequently through the drain passage to the outlet of the drain plug. Once draining of fluids is complete, the drainage tool is removed and the valve member is automatically biased back to a closed position. Replacement of the cover member 66 ensures that no fluids will leak through the drain plug.

If it is desired to remove the drain plug for any reason, a suitable tool is used to expand the circumferential gap of the split ring forming the retainer 94 to enable the retainer to fit over the larger diameter of the intermediate outer surface 76 of the plug body so that the retainer 94 can be subsequently displaced axially along the plug body from the engaged position to the disengaged position thereof. This in turn allows the lock ring to be axially displaced from the locked position to the released position thereof. Once they lock ring is in the released position, the threaded connection between the plug body and the drain hole can be released by rotating the plug body relative to the drain pan.

Since various modifications can be made in the invention as herein above described, and many apparently widely different embodiments of same made, it is intended that all matter contained in the accompanying specification shall be interpreted as illustrative only and not in a limiting sense.

The invention claimed is:

1. A drain plug for cooperation with a drain hole in a boundary wall of a collection pan on an engine in which the drain hole includes an internal screw portion and at least one external stop mounted externally on the boundary wall, the drain plug comprising:

a plug body arranged to occupy the drain hole;

an external screw portion supported on the plug body in which the external screw portion is arranged to form a threaded connection with the internal screw portion on the collection pan when the plug body is inserted into the drain hole in a mounted position of the plug body;

at least one catch formed on the plug body;

a lock ring supported on the plug body such that the lock ring is slidable in an axial direction of the plug body between (i) a released position of the lock ring in which the lock ring does not interfere with rotation of the plug body relative to the collection pan for releasing said threaded connection and (ii) a locked position in which the lock ring is operatively connected between said at least one catch on the plug body and the at least one external stop on the collection pan so as to prevent relative rotation between the plug body and the collection pan and thereby prevent release of said threaded connection; and a retainer supported on the plug body so as to be arranged to selectively retain the lock ring in the locked position;

wherein the lock ring comprises at least one slot extending in a circumferential direction between two opposing end surfaces of the slot; and wherein the at least one slot is arranged to receive the at least one external stop of the collection pan and the at least one catch on the plug body therein between the end surfaces of the slot in the locked position of the lock ring so as to prevent separation of the at least one external stop and the at least one catch from one another in the circumferential direction.

2. The drain plug according to claim 1 wherein the at least one catch on the plug body comprises a lug protruding radially from the plug body.

3. The drain plug according to claim 1 wherein the at least one external stop comprises two external stops at diametrically opposing sides of the drain hole and wherein the at least one catch comprises two catches at diametrically opposing sides of the plug body.

4. The drain plug according to claim 1 wherein the plug body is arranged to be received in the drain hole in the mounted position such that the at least one catch engages the at least one external stop.

5. The drain plug according to claim 1 wherein the plug body is arranged to be received in the drain hole in the mounted position such that the at least one catch on the plug body and the at least one external stop on the collection pan lie in a common plane perpendicular to the axial direction.

6. The drain plug according to claim 1 wherein the plug body is arranged to be received in the drain hole in the mounted position such that at least one gap is defined to extend in a circumferential direction between the at least one catch on the plug body and the at least one external stop on the collection pan, and wherein the lock ring is arranged to fully occupy said at least one gap in the locked position.

7. The drain plug according to claim 6 wherein the lock ring comprises a main body portion which is annular in shape to extend fully about a circumference of the plug body and at least one protruding portion extending axially from the main body portion, said at least one protruding portion extending only partway about the circumference of the plug body between two circumferentially opposed end faces of the protruding portion so as to be arranged to fully occupy said at least one gap in the locked position.

8. The drain plug according to claim 1 wherein the plug body comprises a recessed groove formed in an outer surface of the plug body and wherein the retainer is releasably mounted in the recessed groove to retain the lock ring in the locked position.

9. The drain plug according to claim 8 wherein the outer surface of the plug body locating the recessed groove therein is cylindrical in shape, wherein the recessed groove is annular in shape, and wherein the retainer comprises a resilient split ring arranged to be partly received within recessed groove.

10. The drain plug according to claim 1 wherein the plug body comprises (i) a drain passage communicating through the plug body from an inner opening for communication with an interior of the collection pan to an outer opening for communication with an exterior of the collection pan, (ii) a valve seat defined within the drain passage between the inner opening and the outer opening, (iii) a valve member supported within the plug body for displacement relative to the valve seat between open and closed positions of the valve member, and (iv) a cover member arranged to be releasably secured to an external portion of the plug body so as to enclose the outer opening in a mounted position of the cap member on the plug body.

11. A fluid collection pan assembly for an engine, the fluid collection pan assembly comprising:

a collection pan including a boundary wall, a drain hole formed in the boundary wall, an internal screw portion within the drain hole, and at least one external stop mounted externally on the boundary wall;

a plug body arranged to occupy the drain hole;

an external screw portion supported on the plug body in which the external screw portion is arranged to form a threaded connection with the internal screw portion on the collection pan when the plug body is inserted into the drain hole in a mounted position of the plug body;

at least one catch formed on the plug body;

a lock ring supported on the plug body such that the lock ring is slidable in an axial direction of the plug body between (i) a released position of the lock ring in which the lock ring does not interfere with rotation of the plug body relative to the collection pan for releasing said threaded connection and (ii) a locked position in which the lock ring is operatively connected between said at least one catch on the plug body and the at least one external stop on the collection pan so as to prevent relative rotation between the plug body and the collection pan and thereby prevent release of said threaded connection; and a retainer releasably mounted on the plug body so as to be arranged to selectively retain the lock ring in the locked position;

wherein the lock ring comprises at least one slot extending in a circumferential direction between two opposing end surfaces of the slot, and wherein the at least one slot is arranged to receive the at least one external stop of the collection pan and the at least one catch on the plug body therein between the end surfaces of the slot in the locked position of the lock ring so as to prevent separation of the at least one external stop and the at least one catch from one another in the circumferential direction.

12. The assembly according to claim 11 wherein the plug body is arranged to be received in the drain hole in the mounted position such that at least one gap is defined to extend in a circumferential direction between the at least one catch on the plug body and the at least one external stop on the collection pan, and wherein the lock ring is arranged to fully occupy said at least one gap in the locked position.

13. A drain plug for cooperation with a drain hole in a boundary wall of a collection pan on an engine in which the drain hole includes an internal screw portion and at least one external stop mounted externally on the boundary wall, the drain plug comprising:

a plug body arranged to occupy the drain hole;

an external screw portion supported on the plug body in which the external screw portion is arranged to form a threaded connection with the internal screw portion on the collection pan when the plug body is inserted into the drain hole in a mounted position of the plug body;

at least one catch formed on the plug body;

a lock ring supported on the plug body such that the lock ring is slidable in an axial direction of the plug body between (i) a released position of the lock ring in which the lock ring does not interfere with rotation of the plug body relative to the collection pan for releasing said threaded connection and (ii) a locked position in which the lock ring is operatively connected between said at least one catch on the plug body and the at least one external stop on the collection pan so as to prevent relative rotation between the plug body and the collection pan and thereby prevent release of said threaded connection; and a retainer arranged to be supported on the plug body so as to selectively retain the lock ring in the locked position;

wherein the plug body is arranged to be received in the drain hole in the mounted position such that at least one circumferential gap is defined to extend in a circumferential direction between the at least one catch on the plug body and the at least one external stop on the collection pan; and wherein the lock ring comprises a main body portion which is annular in shape to extend fully about a circumference of the plug body and at least one protruding portion extending axially from the main body portion, said at least one protruding portion extending only partway about the circumference of the plug body between two circumferentially opposed end faces of the protruding portion so as to be arranged to fully occupy said at least one gap in the locked position of the lock ring.

14. The drain plug according to claim 13 wherein the at least one catch on the plug body comprises a lug protruding radially from the plug body.

15. The drain plug according to claim 13 wherein the at least one external stop comprises two external stops at diametrically opposing sides of the drain hole and wherein the at least one catch comprises two catches at diametrically opposing sides of the plug body.

16. The drain plug according to claim 13 wherein the plug body is arranged to be received in the drain hole in the mounted position such that the at least one catch engages the at least one external stop.

17. The drain plug according to claim 13 wherein the plug body is arranged to be received in the drain hole in the mounted position such that the at least one catch on the plug body and the at least one external stop on the collection pan lie in a common plane perpendicular to the axial direction.

18. The drain plug according to claim 13 wherein the plug body comprises a recessed groove formed in an outer surface of the plug body and wherein the retainer is releasably mounted in the recessed groove to retain the lock ring in the locked position.

19. The drain plug according to claim 13 wherein the plug body comprises (i) a drain passage communicating through the plug body from an inner opening for communication with an interior of the collection pan to an outer opening for communication with an exterior of the collection pan, (ii) a valve seat defined within the drain passage between the inner opening and the outer opening, (iii) a valve member supported within the plug body for displacement relative to the valve seat between open and closed positions of the valve member, and (iv) a cover member arranged to be releasably secured to an external portion of the plug body so as to enclose the outer opening in a mounted position of the cap member on the plug body.

* * * * *